United States Patent [19]

Simmons

[11] 4,430,123

[45] Feb. 7, 1984

[54] PRODUCTION OF VERMICULAR GRAPHITE CAST IRON

[75] Inventor: William Simmons, Birmingham, England

[73] Assignee: Foseco International Limited, Birmingham, England

[21] Appl. No.: 290,802

[22] PCT Filed: Nov. 5, 1980

[86] PCT No.: PCT/GB80/00193

§ 371 Date: Aug. 5, 1981

§ 102(e) Date: Aug. 5, 1981

[87] PCT Pub. No.: WO81/01861

PCT Pub. Date: Jul. 9, 1981

[30] Foreign Application Priority Data

Dec. 19, 1980 [GB] United Kingdom ..... 7943698

[51] Int. Cl.[3] ..... C22C 33/08

[52] U.S. Cl. ..... 75/130 R

[58] Field of Search ..... 75/130 R

[56] References Cited

U.S. PATENT DOCUMENTS 2,889,222 6/1959 Kurzinski ..... 75/130 R 3,415,642 12/1968 Matsumoto ..... 75/130 R

FOREIGN PATENT DOCUMENTS 1268706 3/1972 United Kingdom ..... 75/130 R 1515201 6/1978 United Kingdom ..... 75/130 R

*Primary Examiner*—Peter D. Rosenberg

*Attorney, Agent, or Firm*—Cushman, Darby & Cushman

[57] ABSTRACT

Vermicular graphite cast iron is produced by adding to molten iron simultaneously up to 0.3% by weight of the iron of one or more rare earth metals and in excess of 0.2% by weight of the iron of calcium the quantity of rare earth metal being within the range of 2 to 8 times the sulphur content of the molten iron.

The rare earth may be added for example as cerium, mischmetall or as rare earth silicide. The calcium may be added for example as calcium metal or as calcium silicide or a nickel-calcium alloy. An alloy containing both rare earth and calcium, such as a calcium-cerium-silicon alloy, or a composition containing rare earth, calcium and a fluxing agent may also be used.

12 Claims, No Drawings

PRODUCTION OF VERMICULAR GRAPHITE CAST IRON

The invention relates to the production of vermicular graphite cast iron.

The term vermicular graphite cast iron is used to denote cast iron in which flake graphite as been modified to a rounded, shorter form compared with the graphite in normal grey cast iron. This modified form of graphite is also known by other names, including "quasi-flake" and "compacted".

Vermicular graphite cast iron may be produced by treating molten iron with magnesium in conjunction with titanium and one or more rare earth metals. Usually the magnesium is added as a 5% magnesium ferrosilicon containing cerium and titanium is added as ferrotitanium or titanium metal.

However it can be difficult to produce the correct graphite structure when making separate additions of the magnesium, titanium and rare earth metal, and an iron containing excessive titanium or an iron which has a nodular graphite structure due to the presence of insufficient titanium for the quantity of magnesium present can easily result.

These difficulties can be overcome by using special alloys containing magnesium, titanium and rare earth metals, and British Pat. No. 1,427,445 describes the production and use of such alloys.

British Pat. No. 1,515,201 describes a modified alloy of the type disclosed in No. 1,427,445 which in addition contains calcium. The presence of the calcium gives an alloy which, for a given added quantity, produces a vermicular graphite structure over a wider range of initial sulphur contents in the iron compared with an alloy containing no calcium. In thin section castings (less than 5 mm) treatment with magnesium and titanium gives unacceptable quantities of nodules and insufficient compacted graphite when the iron is well inoculated.

It has also been proposed to produce vermicular graphite iron by adding to molten iron one or more rare earth metals, for example cerium or mischmetall, which is a mixture of cerium and other rare earth metals. A process using rare earth metals is described in British Pat. No. 1,268,706. However as is stated in that patent when using rare earth metals alone it is necessary first to desulphurise the molten iron to an abnormally low level or to use a large quantity of rare earth metal in order to obtain a fully vermicular graphite structure. Further, the use of rare earth metals alone is confined to the treatment of hypereutectic irons.

It has now been found that vermicular graphite iron may be produced from molten irons having a wide range of sulphur contents without the need for a preliminary desulphurisation treatment, by the simultaneous addition of a rare earth metal and calcium, providing the additions of rare earth metal and calcium are kept within certain parameters.

According to the invention there is provided a process for treating molten iron containing carbon and sulphur to produce a cast iron having a vermicular graphite structure comprising adding to the molten iron simultaneously up to 0.3% by weight of the iron of one or more rare earth metals and in excess of 0.2% by weight of the iron of calcium the quantity of rare earth metal being within the range of 2 to 8 times the sulphur content of the molten iron.

Preferably the iron contains less than 0.05% by weight sulphur before treatment otherwise excessive dross may be formed in the iron during the treatment process.

If the ratio of the rare earth metal added to the sulphur content of the metal before treatment exceeds 8:1 the graphite is present in the cast iron mainly as spheroids or nodules, and there is also a tendency for carbides to be produced even though the form of the graphite may be good. When the ratio of rare earth metal to sulphur is very high, for example of the order of 18:1, a fully white iron is produced.

When the calcium addition is about 0.2% by weight or below the formation of flake graphite is promoted. Normally the amount of calcium added will not exceed about 0.7% by weight.

In general for a particular sulphur content the lower the quantity of calcium which is added the higher the quantity of rare earth metal added, and vice versa.

Preferably the quantity of calcium added is in the range of 0.25–0.7% by weight of the iron and the rare earth metal to sulphur ratio is in the range of 2.0–5.0.

Provided that the rare earth metal and the calcium are added to the molten iron simultaneously they may be added either as separate additions or in admixture.

The rare earth metal may be a pure metal such as cerium or a mixture of rare earth metals in the form of mischmetall may be used. Mischmetall is a rare earth alloy containing 99.5% rare earths of which 49.5% is cerium. The rare earth may also be added in the form of a rare earth silicide.

The calcium may be added as calcium metal but the calcium preferably added as an alloy for example as calcium silicide or as a nickel-calcium alloy.

Alternatively calcium, cerium and silicon may be alloyed together and the addition made in this way. When such an alloy is used it may be necessary to add additional calcium, for example as calcium silicide, to achieve the desired calcium addition rate.

Particularly when the calcium is added as calcium silicide it may be desirable to also add a fluxing agent, such as calcium fluoride, to improve the dissolution of the calcium in the molten iron.

According to a further feature of the invention therefore there is provided a composition for use in the production of vermicular graphite iron which comprises one or more rare earth metals, calcium and a fluxing agent.

Usually the composition will contain 1.5–10% by weight of rare earth metal, 15–35% by weight of calcium and 6–10% by weight of fluxing agent, the remainder being iron and silicon, acting as carriers.

The rare earth metal, calcium and fluxing agent may be mixed together and compacted to form briquettes, tablets or pellets to facilitate adding the composition to the molten iron, or the rare earth metal and calcium may be alloyed. The flux is then mixed with the alloy.

After treatment with the rare earth metal and calcium the iron is treated with an inoculent such as ferrosilicon in the normal way prior to casting.

The process and composition of the invention offer a number of advantages over existing processes and compositions which are used to produce vermicular graphite cast iron:

1. By adding calcium simultaneously with cerium or other rare earth metal it is possible to reduce the amount of rare earth metal added considerably. As little as one fifth of the usual rare earth addition may be needed when calcium is added as well, and since it would be usual to add rare earth at a rate of at least 10 times the initial sulphur content when using rare earth alone the saving in rare earth metal is appreciable.

2. The use of a combination of calcium and rare earth metal gives results which are less sensitive to the differences in casting section thickness than processes using magnesium and titanium, and there is less tendency to produce undesirable nodular graphite structures.

3. Treatment of molten iron with a calcium-rare earth composition produces a quiet reaction unlike that of magnesium which give rise to flaring and bubbling of the molten iron.

4. Scrap iron e.g. casting runners and risers resulting from the process can be remelted without the need to take any special precautions. In a foundry producing both nodular iron and vermicular graphite iron castings, and using the magnesium-titanium process to produce the latter, it would be necessary to segregate any scrap containing titanium to prevent it being remelted and used for nodular iron production.

The following examples will serve to illustrate the invention:

EXAMPLE 1

A charge of pig iron and steel scrap was melted and a sample taken for chemical analysis. The sulphur content of the iron was determined as 0.051% by weight. The molten iron was heated to 1550° C. and 22 kg was tapped on to a mixture of 0.2% by weight based on the weight of the iron of mischmetall and 1.6% by weight based on the weight of the iron of calcium silicide in a hand ladle. Slag was removed from the iron which was then transferred to a second hand ladle, 0.5% by weight on the weight of the iron of ferrosilicon being added to inoculate the iron during the transfer process. The treated iron was then cast at 1450° C. into a green sand mould and the casting produced was sectioned and its microstructure examined. The casting had a vermicular or compacted graphite structure and a matrix structure of pearlite and ferrite haloes.

A similar result was obtained using 1.9% by weight of calcium silicide instead of 1.6%.

EXAMPLE 2

The procedure of Example 1 was repeated except that the iron had a sulphur content of 0.056% and 0.16% by weight based on the weight of iron treated of calcium fluoride was included as a fluxing agent to aid dissolution of the calcium silicide.

The cast iron produced had a vermicular graphite structure with a pearlitic matrix.

EXAMPLE 3

Using the procedure of Example 1 molten iron having a low sulphur content (0.011%) was treated with 1.5% calcium silicide, 0.19% calcium fluoride and 0.04% mischmetall, followed by 0.5% ferrosilicon (all percentages by weight based on the weight of iron treated).

A cast iron having a vermicular graphite structure and a matrix consisting of 70% ferrite and 30% pearlite was produced.

EXAMPLE 4

Using the procedure of Example 1 various iron melts were treated using compositions based in some cases on mischmetall and calcium silicide and in other cases on calcium, cerium and silicon alloys.

The sulphur content of the molten iron varied from 0.008% to 0.056% and the ratio of rare earth metal added to sulphur content varied from 1.79 to 25.0. The quantity of calcium added varied from 0.16% to 0.53%.

The results obtained are tabulated below:

| No. | Initial Sulphur (S) (%) | Rare Earths (RE) Added (%) | RE/S | Calcium Added (%) | Graphite Form | Matrix Ferrite %/ Pearlite % |
|---|---|---|---|---|---|---|
| 1 | 0.013 | 0.051 | 3.92 | 0.16 | Coarse Flake | 70/30 |
| 2 | 0.013 | 0.053 | 4.08 | 0.20 | Under-cooled Flake | 90/10 |
| 3 | 0.013 | 0.055 | 4.23 | 0.24 | Vermicular | 60/40 |
| 4 | 0.013 | 0.054 | 4.15 | 0.27 | Vermicular | 60/40 |
| 5 | 0.013 | 0.052 | 4.06 | 0.36 | Vermicular | 50/50 |
| 6 | 0.013 | 0.067 | 5.15 | 0.34 | Vermicular | 50/50 |
| 7 | 0.056 | 0.10 | 1.79 | 0.53 | Coarse Flake | 0/100 |
| 8 | 0.056 | 0.20 | 3.58 | 0.53 | Vermicular | 2/98 |
| 9 | 0.008 | 0.20 | 25.0 | 0.51 | NIL | 100% $Fe_3C$ |
| 10 | 0.017 | 0.031 | 1.82 | 0.31 | Fine Flake | 95/5 |
| 11 | 0.017 | 0.042 | 2.47 | 0.32 | Vermicular | 60/40 |
| 12 | 0.009 | 0.154 | 17.1 | 0.53 | Nodular | 30/70 |
| 13 | 0.009 | 0.167 | 18.6 | 0.53 | NIL | 100% $Fe_3C$ |

Irons Nos. 3–6, 8 and 11 had all been treated according to the process of the invention and all had vermicular graphite structures. The remainder, which were not produced by the process of the invention did not contain vermicular graphite.

EXAMPLE 5

In a foundry production trial 360 kg of iron of 0.014% sulphur was treated with a composition containing rare earth-calcium-silicon alloy plus calcium silicide to give a calcium addition to the iron of 0.45% and a rare earth addition of 0.11% (i.e. a rare earth/sulphur ratio of 8:1), followed by an inoculation with 0.8% to FeSi. Several complex, highly-cored multi-spool hydraulic valve bodies were cast. These intricate castings contain complex internal passageways and have a variety of interconnected sections, varying in thickness from 5 mm to 30 mm, each casting weighing about 9 kg.

Some randomly selected castings were cleaned and sectioned and the microstructures of the sections were examined. The structures were as shown below, indicating that change in section thickness had little effect on the graphite form.

| Section Thickness (mm) | Graphite | Matrix Ferrite %/Pearlite % |
|---|---|---|
| 30 | Vermicular | 60/40 |
| 8 | Vermicular | 70/30 |
| 5 | Vermicular + 5% nodules | 90/10 |

I claim:

1. In a process for treating molten iron containing carbon and sulphur to produce a cast iron having a vermicular graphite structure, the improvement which comprises determining the sulphur content of the iron and adding to the molten iron simultaneously up to 0.3% by weight of the iron of one or more rare earth metals as such or as an alloy thereof and in excess of 0.2% by weight of the iron of calcium as such or as an alloy thereof, the quantity of rare earth metal added being within the range of 2 to 8 times the sulphur content of the molten iron and such as to give the iron when cast a vermicular graphite structure.

2. A process according to claim 1 wherein the amount of calcium added does not exceed 0.7% by weight of the iron.

3. A process according to claim 1 wherein the amount of rare earth metal added is within the range of 2–5 times the sulphur content of the molten iron.

4. A process according to claim 1 wherein the rare earth metal is added as mischmetall or rare earth silicide.

5. A process according to claim 1 wherein the calcium is added as calcium silicide or a nickel-calcium alloy.

6. A process according to claim 1 wherein the rare earth metal and at least part of the calcium are added as a cerium-calcium-silicon alloy.

7. A process according to claim 1 wherein a fluxing agent is also added in order to improve the dissolution of the calcium.

8. A composition for use in the process of claim 1 which comprises 1.5–10% by weight of one or more rare earth metals as such or in alloy form, 15–35% by weight of calcium as such or in alloy form and 6–10% by weight of a fluxing agent, the balance being iron and silicon acting as carriers.

9. A composition according to claim 8 wherein the rare earth metal is present as mischmetall or rare earth silicide.

10. A composition according to claim 8 wherein the calcium is present as calcium silicide or a nickel-calcium alloy.

11. A composition according to claim 8 wherein the rare earth metal and at least part of the calcium are present as a cerium-calcium-silicon-alloy.

12. A composition according to claim 8 wherein the fluxing agent is calcium fluoride.

* * * * *

UNITED STATES PATENT AND TRADEMARK OFFICE

CERTIFICATE OF CORRECTION

PATENT NO. : 4,430,123

DATED : February 7, 1984

INVENTOR(S) : William Simmons

It is certified that error appears in the above-identified patent and that said Letters Patent is hereby corrected as shown below:

In the heading of the patent, correct to read:

--[30] Foreign Application Priority Data

Dec. 19, 1979 [GB] United Kingdom....7943698--

Signed and Sealed this

*Twenty-sixth* Day of *February 1985*

[SEAL]

*Attest:*

DONALD J. QUIGG

*Attesting Officer* *Acting Commissioner of Patents and Trademarks*